US007069821B2

(12) United States Patent
Hwang

(10) Patent No.: US 7,069,821 B2
(45) Date of Patent: Jul. 4, 2006

(54) MOVABLE JAW TYPE HOLDING DEVICE

(76) Inventor: Cherng-Bin Hwang, No. 76-1, Liu Tzu Lin, Liu Lin Village, Shui Shang Hsiang, Chia Yi Hsien (TW)

( * ) Notice: Subject to any disclaimer, the term of this patent is extended or adjusted under 35 U.S.C. 154(b) by 97 days.

(21) Appl. No.: 10/947,675

(22) Filed: Sep. 23, 2004

(65) Prior Publication Data

US 2005/0034571 A1 Feb. 17, 2005

Related U.S. Application Data

(63) Continuation-in-part of application No. 10/385,943, filed on Mar. 10, 2003, now abandoned.

(51) Int. Cl.
*B25B 13/54* (2006.01)
*B25B 13/28* (2006.01)

(52) U.S. Cl. ..... 81/176.3; 81/99; 81/461

(58) Field of Classification Search ..... 81/176.1, 81/176.15, 176.2, 176.3, 461, 417, 3.44, 81/98, 99

See application file for complete search history.

(56) References Cited

U.S. PATENT DOCUMENTS

| | | | | |
|---|---|---|---|---|
| 767,403 | A | 8/1904 | Glover et al. | 81/417 |
| 1,006,348 | A | 10/1911 | Beran | 81/176.3 |
| 1,425,845 | A | 8/1922 | Foster | 81/176.15 |
| 1,579,992 | A | 4/1926 | Alexander | 81/176.15 |
| 2,444,371 | A | 6/1948 | Riccio | 81/176.3 |
| 2,519,073 | A | 8/1950 | Schaub | 81/176.3 |
| 4,563,833 | A | 1/1986 | Aucoin | 81/417 |
| 4,919,021 | A | 4/1990 | Franks | 81/417 |
| 6,128,943 | A | 10/2000 | Lemmens | 81/416 |
| 6,167,784 | B1 | 1/2001 | Lin | 81/99 |

*Primary Examiner*—Debra S Meislin
(74) *Attorney, Agent, or Firm*—Alan D. Kamrath; Nikolai & Mersereau, P.A.

(57) ABSTRACT

A movable jaw holding device includes a handle having a fixed jaw member holding a first rod member. A movable jaw member is pivoted to the handle by a pivot and holds a second rod member. A C-shaped retainer fastened to the shank of the pivot secures to secures the pivot to the handle and the movable jaw member. A spring member mounted on the pivot and stopped between the fixed jaw member and the movable jaw member is well protected by the head of the pivot and a cushion ring at one end of the pivot.

7 Claims, 7 Drawing Sheets

MOVABLE JAW TYPE HOLDING DEVICE

CROSS-REFERENCE

The present application is a continuation-in-part application of U.S. patent application Ser. No. 10/385,943, filed Mar. 10, 2003, now abandoned.

BACKGROUND OF THE INVENTION

1. Field of the Invention

The present invention relates to a hand tool and, more particularly, to a movable jaw type holding device.

2. Description of the Related Art

U.S. Pat. No. 1,006,348 discloses a device having a handle A, a movable jaw B and a spring C. The handle A has a fixed jaw N at one end. The movable jaw B is pivoted to the handle A adjacent to the fixed jaw N. The spring C is pivoted to the handle A by a pin E, having one end stopped against the movable jaw B and the other end stopped against the pin. The movable jaw B is biasable relative to the fixed jaw N. This design has drawbacks. Because the spring C is provided at an outer side relative to the movable jaw B, it is exposed to the outside and tends to be damaged or deformed by an impact accidentally. Further, because no fastening means is provided to secure the spring C to the pin E firmly, the spring C tends to be forced away from the pin E accidentally.

U.S. Pat. No. 4,563,833 discloses a fish holding device of the pliers type having two identical handle and jaw members 10 and 12 pivoted together with a pivot 14. The handle and jaw members 10 and 12 have hand grip portions 16 and 18. The handle and jaw members 10 and 12 have thin axially extending pads 36 and 38. The handle and jaw members 10 and 12 are yieldingly urged to the open position by a spring 54 having a central portion 56 wrapped about the thin pads 36 and 38 of the handle portions 10 and 12 and having terminal extensions 58 and 60 engaging the inner edges of the jaw members 22 and 24 to yieldingly urge the handle and jaw members to separate to the operative or fish receiving position. This design of fish holding device of the pliers type is still not satisfactory in function. One drawback of this design of fish holding device of the pliers type is that the space in between the jaw members 10 and 12 around the spring 54 tends to be covered with dust. Another drawback of this design of fish holding device of the pliers type is that the limited contact area between the thin pads 36 and 38 of the handle portions 10 and 12 is insufficient to support the jaw members 10 and 12 stably in balance, and the jaw members 10 and 12 will start to vibrate after long use of the device. Still another drawback of this design of fish holding device of the pliers type is that the pivot 14 (screw bolt 42 and nut 48) pivotally securing the two identical handle and the jaw members 10 and 12 together wears quickly with use, resulting in vibration of the jaw members 10 and 12.

SUMMARY OF THE INVENTION

The present invention has been accomplished under the circumstances in view. It is the main object of the present invention to provide a movable jaw type holding device, which is stable and durable in use. It is another object of the present invention to provide a movable jaw type holding device, which eliminates deposition of dust to the gaps in between the parts.

To achieve these and other objects of the present invention, the movable jaw type holding device comprises a handle, the handle a having fixed jaw member, two recessed portions symmetrically disposed at two opposite sides adjacent to an inner end of the fixed jaw, and a pivot hole extended through the recessed portions; a movable jaw member pivotally coupled to the handle, the movable jaw member having a first end, a second end, two lugs formed in the first end and respectively attached to the recessed portions of the handle, the lugs each having a pivot hole respectively aligned with the pivot hole of the handle; a first rod member connected to one end of the fixed jaw member at one side; a second rod member connected to the second end of the movable jaw member at one side corresponding to the first rod member; a spring member provided between the handle and the movable jaw member, the spring member having a first end stopped at the fixed jaw, a second end stopped at the movable jaw member, and two coiled portions arranged in parallel on the middle between the first end and second end of the spring member and respectively attached to the lugs of the movable jaw member at an outer side, the coiled portions each defining a hole; a pivot pivotally securing the movable jaw member and the spring member and the handle together, the pivot comprising a shank fastened to the hole of each coiled portion of the spring member and the pivot hole of the handle and the pivot holes of the lugs of the movable jaw member to pivotally secure the handle and the spring member and the movable jaw member together, a head provided at one end of the shaft and stopped against one coiled portion of the spring member at an outer side, a shoulder connected between the shank and head of the pivot and supporting one coiled portion of the spring member, and a locating groove extended around the periphery of the shank near one end remote from the shoulder and head of the pivot; a C-shaped retainer fastened to the locating groove of the pivot to secure the pivot to the handle and the movable jaw member; and a cushion ring mounted on the shank of the pivot and stopped between the C-shaped retainer and one lug of the movable jaw member, the cushion ring having a ring body that supports one coiled portion of the spring member, a flange that stops the respective coiled portion of the spring member from falling out of the ring body.

DETAILED DESCRIPTION OF THE INVENTION

Figure 1:
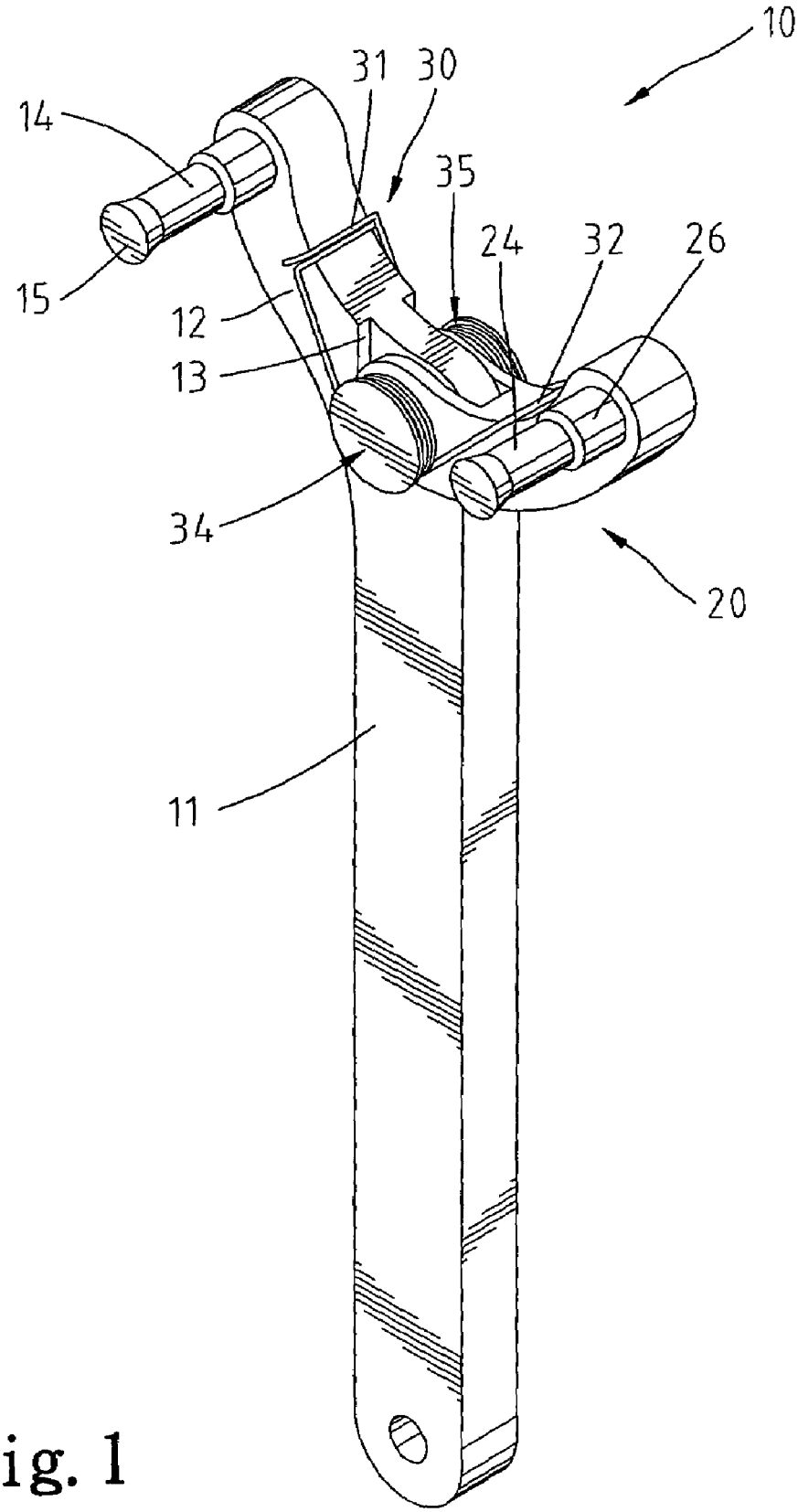
FIG. 1 is a perspective view of a movable jaw type holding device according to the present invention.

Referring to FIG. 1, a movable jaw type holding device 10 in accordance with the present invention is shown including a handle 11, a movable jaw member 20, and a spring member 30. The handle 11 has one end terminating in a fixed jaw member 12. A pivot 34 pivots the movable jaw member 20 to the handle 11 adjacent to the fixed jaw member 12. The spring member 30 is mounted on the pivot 34, having two distal ends 31 and 32 respectively stopped against the fixed jaw member 12 and the movable jaw member 20. Further, first and second rod members 14 and 24 are respectively affixed to the fixed jaw member 12 and the movable jaw member 20 for holding or turning things.

Figure 2:
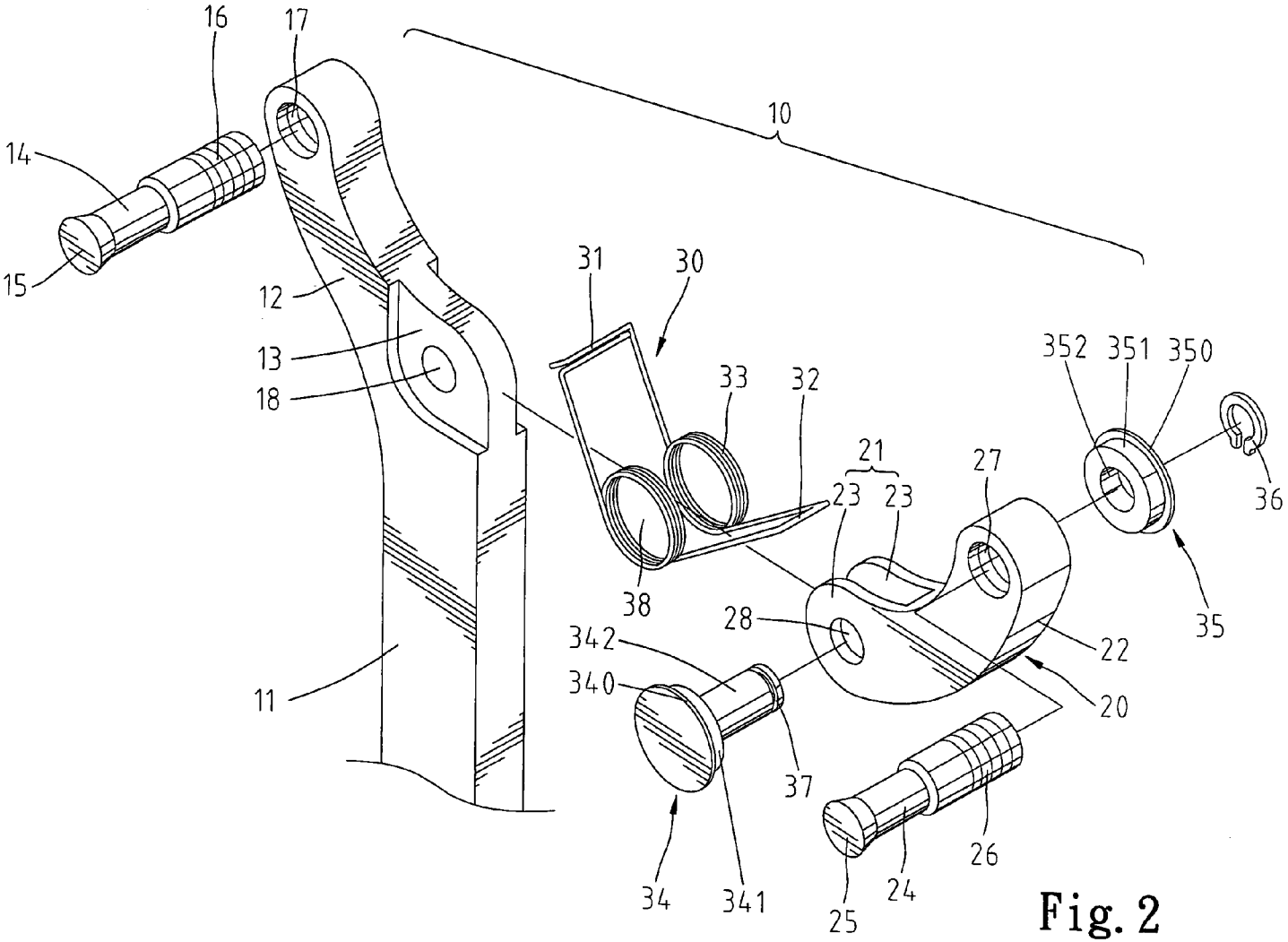
FIG. 2 is an exploded view of the movable jaw type holding device according to the present invention.
Figure 3:
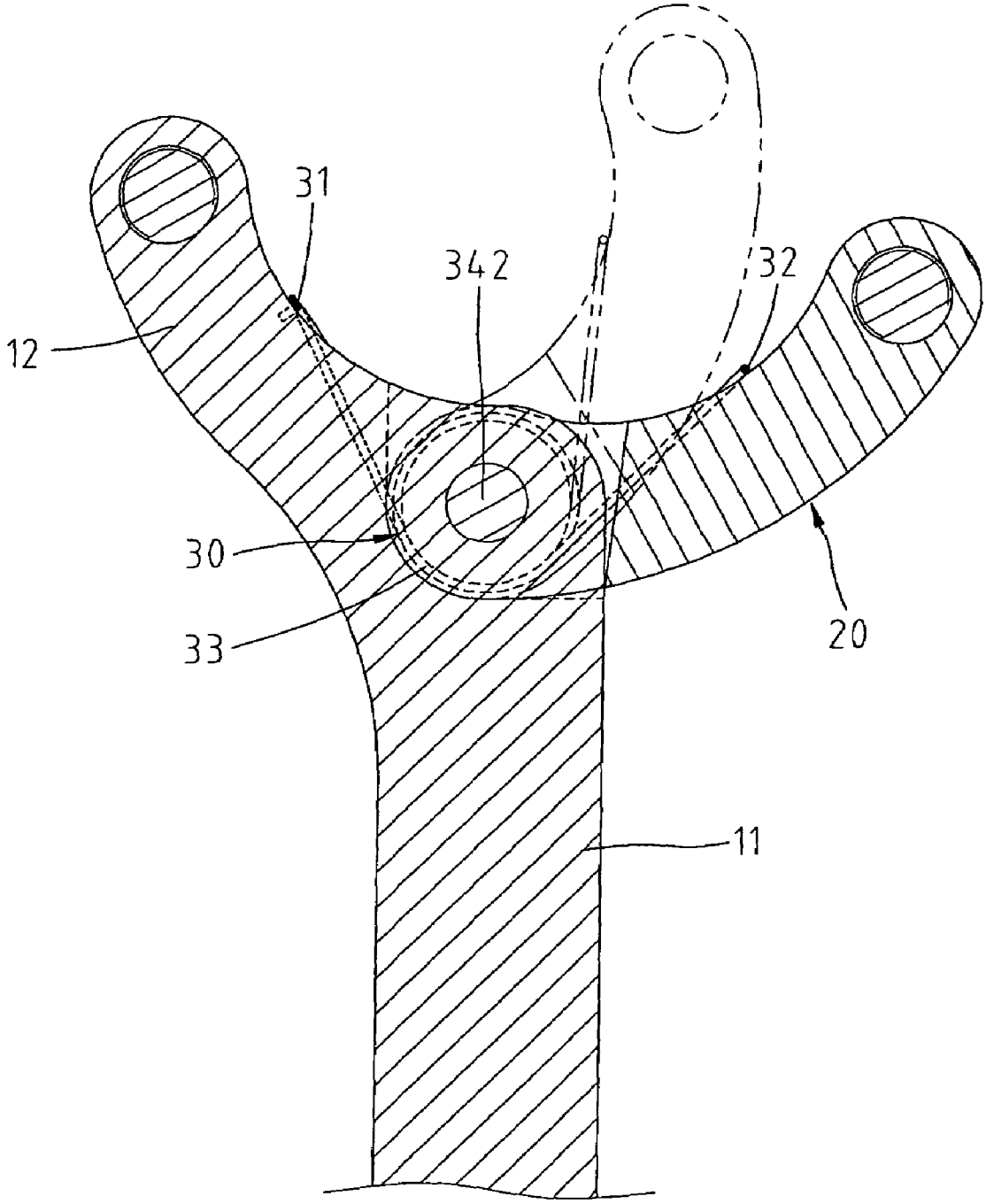
FIG. 3 is a sectional view of the movable jaw type holding device according to the present invention.

Referring to FIGS. 2 and 3 and FIG. 1 again, the fixed jaw member 12 has a screw hole 17 transversely disposed at the distal one end thereof for holding the first rod member 14. The first rod member 14 has a tapered head 15 at one end, and a screw rod 16 at the other end for threading into the screw hole 17 of the fixed jaw member 12. The handle 11 has two recessed portions 13 symmetrically disposed at two opposite sides adjacent to proximity end of the fixed jaw member 12 remote from the screw hole 17, and a pivot hole 18 extended through the recessed portions 13.

The movable jaw member 20 has a first end 21, a second end 22, two lugs 23 formed in the first end 21 and arranged in parallel, two pivot holes 28, respectively, formed in the lugs 23 and aligned in line, and a screw hole 27 transversely formed in the second end 22 for holding the second rod member 24. The second rod member 24 has a tapered head 25 at one end, and a screw rod 26 at the other end for threading into the screw hole 27 of the movable jaw member 20. The two lugs 23 of the movable jaw 20 are respectively attached and pivotally connected to the recessed portions 13 of the handle 11, keeping the pivot holes 28 and 18 axially aligned.

The spring member 30 is provided between the handle 11 and the movable jaw member 20, having two coiled portions 33 arranged in parallel on the middle between the two distal ends 31 and 32 and respectively attached to the recessed portions 13 of the handle 11. The coiled portions 33 define a respective hole 38 set in alignment with the pivot hole 18 of the handle 11 and the pivot holes 28 of the movable jaw 20.

The aforesaid pivot 34 is inserted through the holes 38 of the coiled portions 33 of the spring member 30 and the pivot hole 18 of the handle 11 and the pivot holes 28 of the movable jaw member 20 to pivotally secure the handle 11, the spring member 30 and the movable jaw member 20 together. The pivot 34 has a shank 342, a locating groove 37 extended around the periphery of the shank 342 at one end, a head 340 at one end of the shank 342 remote from the locating groove 37, and a shoulder 341 connected between the shank 342 and the head 340. The shank 342 is inserted through the holes 38 of the coiled portions 33 of the spring member 30 and the pivot hole 18 of the handle 11 and the pivot holes 28 of the movable jaw member 20. The shoulder 341 supports one coiled portion 33 of the spring member 30. The head 340 stops the respective coiled portion 33 of the spring member 30 from falling out of the shoulder 341. Further, a cushion ring 35 is mounted on the shank 342 of the pivot 34 and stopped at one recessed portion 13 of the handle 11, and a C-shaped retainer 36 is fastened to the locating groove 37 to secure to the pivot 34 to the handle 11 and the movable jaw member 20 and to secure the cushion ring 35 in place. The cushion ring 35 has a ring body 351 that supports the other coiled portion 33 of the spring member 30, a flange 350 that stops the respective coiled portion 33 of the spring member 30 from falling out of the ring body 351, and a center hole 352 for the passing of the shank 342 of the pivot 34.

Referring to FIG. 3 again, when an external force biases the movable jaw member 20, it turns about the pivot 34 relative to the fixed jaw member 12 at the handle 11. When the external biasing force disappears, the spring power of the spring member 30 immediately returns the movable jaw member 20 to the former extended position.

Figure 4:
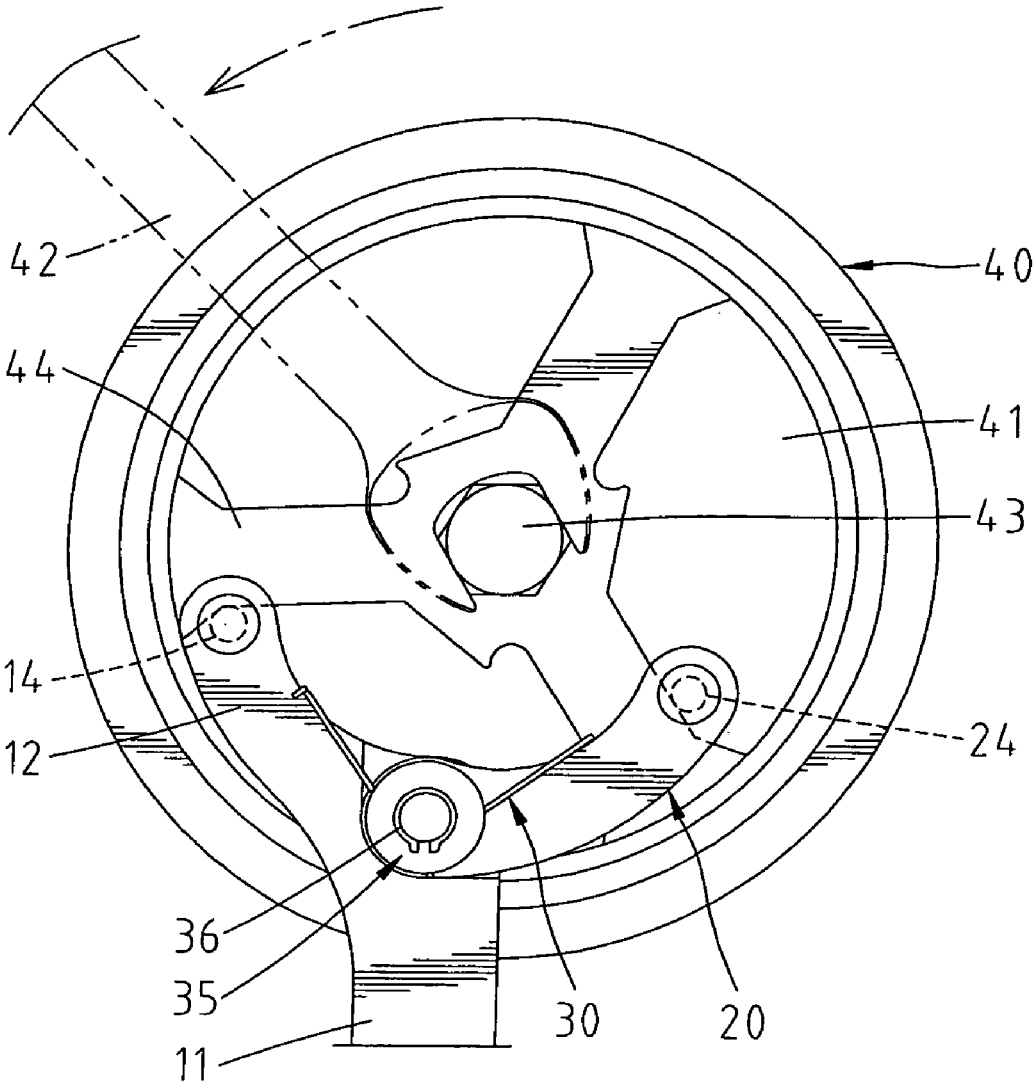
FIG. 4 shows one application example of the present invention.

FIG. 4 shows one application example of the present invention. As illustrated, the first rod member 14 and the second rod member 24 are inserted into the holes 41 of a big wheel 40 and stopped at 44 of the wheel 40. Thus, when operating an open-end wrench 42 to rotate one screw bolt 43 of the wheel 40, the wheel 40 is prohibited from rotation with the screw bolt 43. Therefore, the wheel 40 can quickly be detached from the machine.

Figure 5:
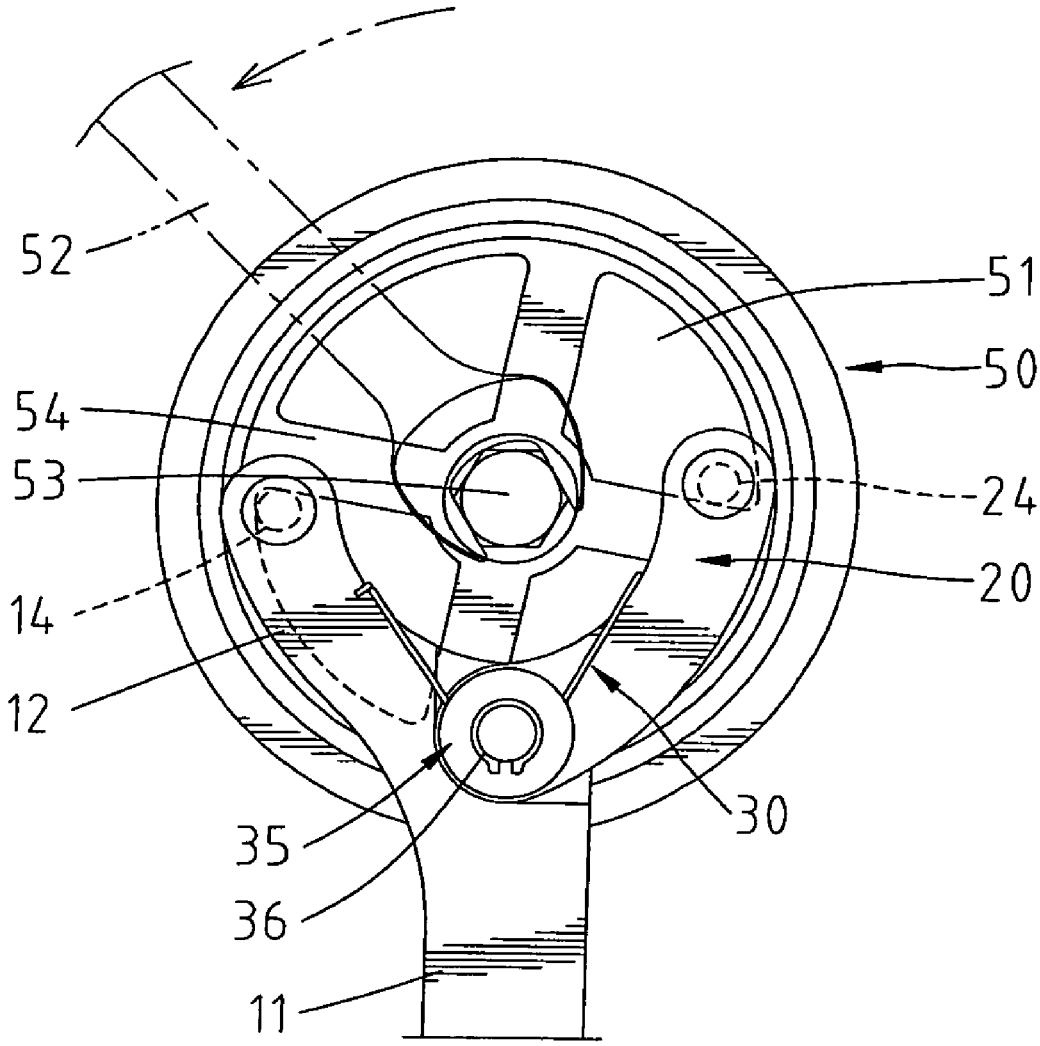
FIG. 5 shows another application example of the present invention.

FIG. 5 shows another application example of the present invention. As illustrated, the first rod member 14 and the second rod member 24 are respectively inserted into the holes 51 of a small wheel 50. When operating an open-end wrench 52 to rotate one screw bolt 53 of the wheel 50, the first rod member 14 and the second rod member 24 are respectively stopped at 54 of the wheel 50, prohibiting the wheel 50 from rotation with the screw bolt 53. Therefore, the invention is suitable for applicable to different sizes of wheels 40, 50.

Figure 6:
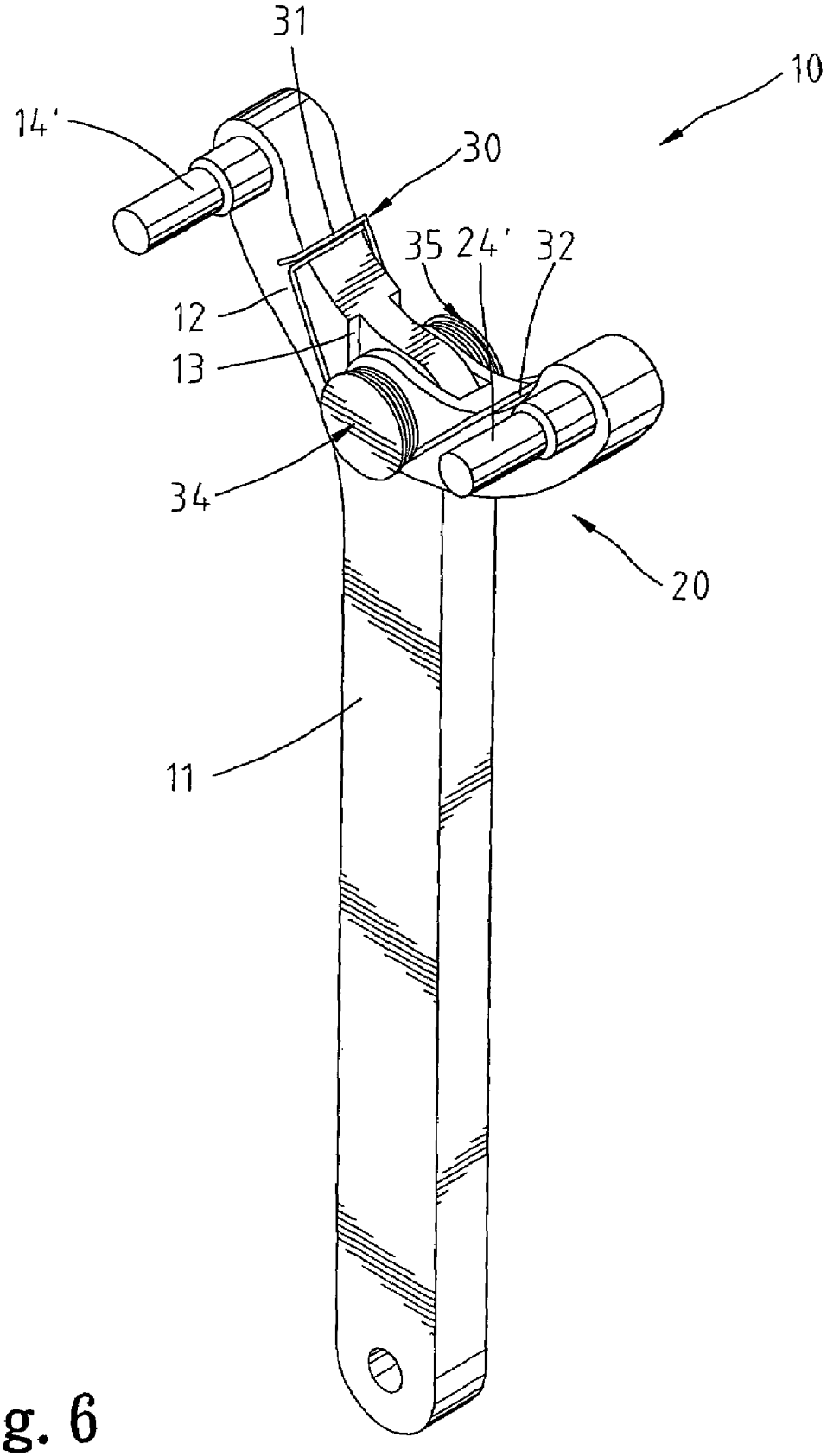
FIG. 6 shows an alternate form of the movable jaw type holding device according to the present invention.

FIG. 6 shows an alternate form of the movable jaw type holding device according to the present invention. According to this embodiment, the aforesaid tapered heads 15 and 25 ares respectively, eliminated from the first rod member 14 and the second rod member 24'.

Figure 7:
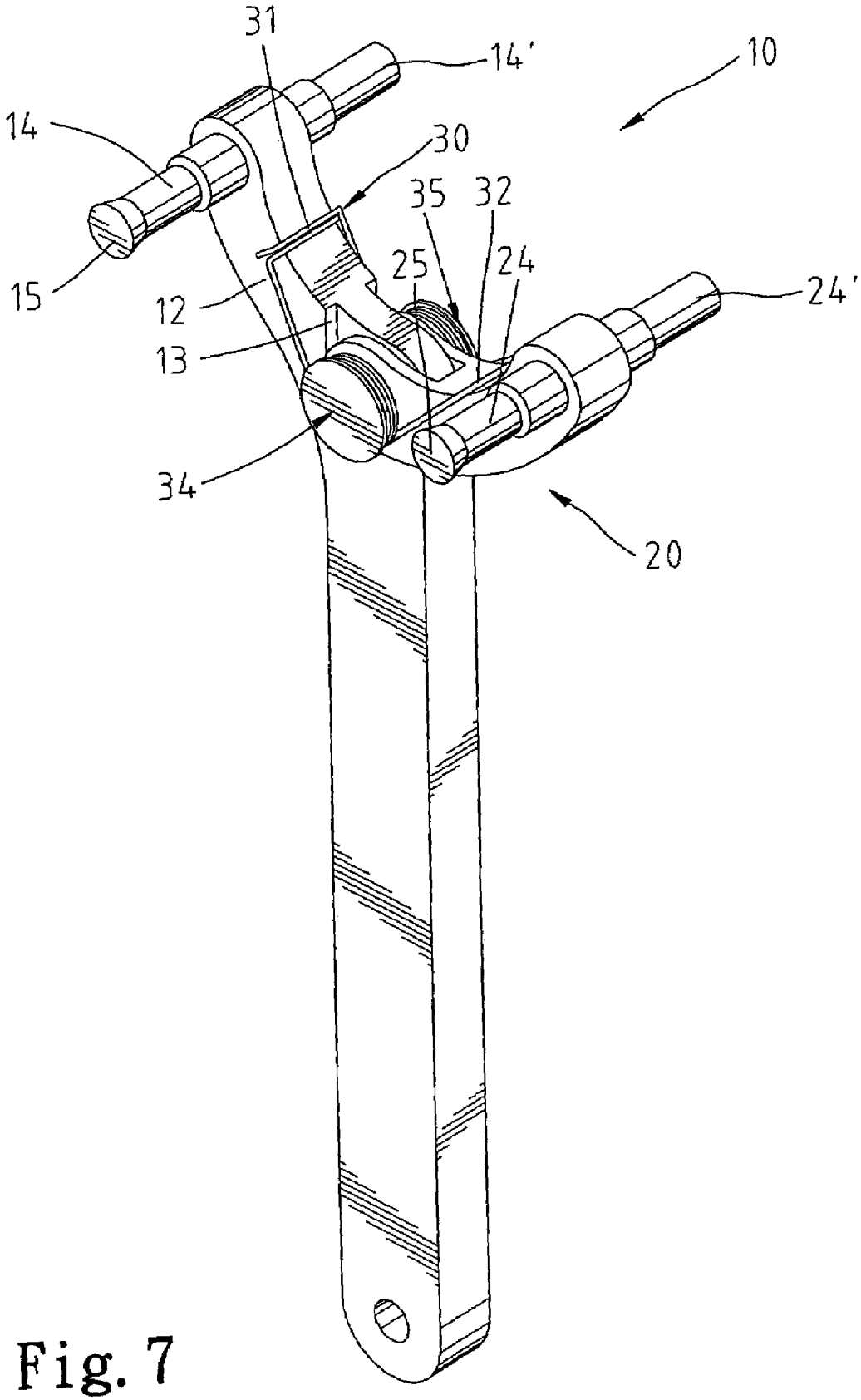
FIG. 7 shows another alternate form of the movable jaw type holding device according to the present invention.

FIG. 7 shows another alternate form of the present invention. According to this embodiment, the fixed jaw member 12 and the movable jaw member 20 each have a stop rod 14' or 24' fixedly provided at one side opposite to the respective screw hole 17 or 27. This embodiment is practical for operation in either of two opposite sides.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A movable jaw type holding device comprising:

a handle, said handle having a fixed jaw member, two recessed portions symmetrically disposed at two opposite sides adjacent to an inner end of said fixed jaw, and a pivot hole extended through said recessed portions;

a movable jaw member pivotally coupled to said handle, said movable jaw member having a first end, a second end, two lugs formed in said first end and respectively attached to the recessed portions of said handle, said lugs each having a pivot hole respectively aligned with the pivot hole of said handle;

a first rod member connected to one end of said fixed jaw member at one side;

a second rod member connected to the second end of said movable jaw member at one side corresponding to said first rod member;

a spring member provided between said handle and said movable jaw member, said spring member having a first end stopped at said fixed jaw, a second end stopped at said movable jaw member, and two coiled portions arranged in parallel on the middle between the first end and second end of said spring member and respectively attached to the lugs of said movable jaw member at an outer side, said coiled portions each defining a hole;

a pivot pivotally securing said movable jaw member and said spring member and said handle together, said pivot comprising a shank fastened to the hole of each coiled portion of said spring member and the pivot hole of said handle and the pivot holes of the lugs of said movable jaw member to pivotally secure said handle and said spring member and said movable jaw member together, a head provided at one end of said shaft and stopped against one coiled portion of said spring member at an outer side, and a shoulder connected between the shank and head of said pivot and supporting one coiled portion of said spring member; and a cushion ring mounted on the shank of said pivot and stopped against one lug of said movable jaw member, said cushion ring having a ring body that supports one coiled portion of said spring member, a flange that stops the respective coiled portion of said spring member from falling out of said ring body.

2. The movable jaw type holding device as claimed in claim 1, wherein said first rod member has a first end terminating in a tapered head.

3. The movable jaw type holding device as claimed in claim 2, wherein said fixed jaw member has a screw hole; said first rod member has a second end terminating in a screw rod for fastening into the screw hole of said fixed jaw member.

4. The movable jaw type holding device as claimed in claim 1, wherein said second rod member has a first end terminating in a tapered head.

5. The movable jaw type holding device as claimed in claim 4, wherein said movable jaw member has a screw hole; said second rod member has a second end terminating in a screw rod for fastening into the screw hole of said fixed jaw member.

6. The movable jaw type holding device as claimed in claim 1, wherein said fixed jaw member and said movable jaw member each have a fixed rod respectively disposed at one side opposite to said first rod member and said second rod member.

7. The movable jaw type holding device as claimed in claim 1, wherein said shank of said pivot has a locating groove extended around the periphery thereof near one end remote from said shoulder for the mounting of a C-shaped retainer to secure said pivot to said handle and said movable jaw member.

* * * * *